US009014377B2

(12) United States Patent
Goodwin et al.

(10) Patent No.: US 9,014,377 B2
(45) **Date of Patent: *Apr. 21, 2015**

(54) MULTICHANNEL SURROUND FORMAT CONVERSION AND GENERALIZED UPMIX

(75) Inventors: Michael M. Goodwin, Scotts Valley, CA (US); Jean-Marc Jot, Aptos, CA (US)

(73) Assignee: Creative Technology Ltd, Singapore (SG)

( * ) Notice: Subject to any disclaimer, the term of this patent is extended or adjusted under 35 U.S.C. 154(b) by 883 days.

This patent is subject to a terminal disclaimer.

(21) Appl. No.: 12/048,180

(22) Filed: Mar. 13, 2008

(65) Prior Publication Data

US 2008/0232617 A1 Sep. 25, 2008

Related U.S. Application Data

(63) Continuation-in-part of application No. 11/750,300, filed on May 17, 2007.

(60) Provisional application No. 60/747,532, filed on May 17, 2006, provisional application No. 60/894,622, filed on Mar. 13, 2007.

(51) Int. Cl.

| | |
|---|---|
| ***H04R 5/00*** | (2006.01) |
| ***G10L 19/00*** | (2013.01) |
| ***G10L 19/16*** | (2013.01) |
| ***G10L 19/008*** | (2013.01) |
| ***H04S 1/00*** | (2006.01) |
| ***H04S 3/00*** | (2006.01) |

(52) U.S. Cl.
CPC ..... *G10L 19/173* (2013.01); *G10L 19/008* (2013.01); *H04S 1/002* (2013.01); *H04S 3/008* (2013.01)

(58) Field of Classification Search
USPC ..... 381/307–310, 17–23, 1, 119; 704/200.1, 230, E19.005, E19.001; 700/94
See application file for complete search history.

(56) References Cited

U.S. PATENT DOCUMENTS

| | | | | |
|---|---|---|---|---|
| 2006/0093152 | A1* | 5/2006 | Thompson et al. | 381/17 |
| 2007/0269063 | A1* | 11/2007 | Goodwin et al. | 381/310 |
| 2008/0205676 | A1* | 8/2008 | Merimaa et al. | 381/310 |
| 2008/0232616 | A1* | 9/2008 | Pulkki et al. | 381/300 |
| 2008/0267413 | A1* | 10/2008 | Faller | 381/1 |

OTHER PUBLICATIONS

Avendano et al; "Frequency Domain Techniques for stereo to multichannel upmix"; Jun. 2002.*

* cited by examiner

*Primary Examiner* — Vivian Chin
*Assistant Examiner* — David Ton
(74) *Attorney, Agent, or Firm* — Russell Swerdon; Desmund Gean

(57) ABSTRACT

An audio signal is processed in the frequency domain to convert an input signal format to an output signal format. That is, a multichannel audio signal intended for playback over a predefined speaker layout can be formatted to achieve spatial reproduction over a different layout comprising a different number of speakers.

14 Claims, 10 Drawing Sheets

MULTICHANNEL SURROUND FORMAT CONVERSION AND GENERALIZED UPMIX

CROSS-REFERENCE TO RELATED APPLICATIONS

This application is a continuation-in-part of U.S. patent application Ser. No. 11/750,300, which is entitled Spatial Audio Coding Based on Universal Spatial Cues, and filed on May 17, 2007 which claims priority to and the benefit of the disclosure of U.S. Provisional Patent Application Ser. No. 60/747,532, filed on May 17, 2006, and entitled Spatial Audio Coding Based on Universal Spatial Cues, the specifications of which are incorporated herein by reference in their entirety. Further, this application claims priority to and the benefit of the disclosure of U.S. Provisional Patent Application Ser. No. 60/894,622, filed on Mar. 13, 2007, and entitled Multichannel Surround Format Conversion and Generalized Upmix, which is incorporated herein by reference in its entirety.

BACKGROUND OF THE INVENTION

1. Field of the Invention

The present invention relates to signal processing techniques. More particularly, the present invention relates to methods for processing audio signals based on spatial audio cues.

2. Description of the Related Art

A common limitation of existing time-domain approaches to multichannel audio format conversion is that the reproduction causes spatial spreading or "leakage" of a given directional sound event into loudspeakers other than those nearest the due direction of the event. This affects the perceived "sharpness" of the spatial image of the sound event and the robustness of the spatial image with respect to listener position.

What is desired is an improved format conversion technique.

SUMMARY OF THE INVENTION

Provided is a frequency-domain method for format conversion of a multichannel audio signal, intended for playback over a pre-defined loudspeaker layout, in order to achieve accurate spatial reproduction over a different layout potentially comprising a different number of loudspeakers.

In accordance with one embodiment, a format conversion method for multichannel surround sound such as contained in an audio recording is provided. In order to convert from the input format to an output format, an initial operation involves converting the signals to a frequency-domain or subband representation. For each time and frequency in the time-frequency signal representation, a spatial localization vector is derived by a spatial analysis algorithm. Further, for each time and frequency, a scaling factor associated with each output channel is determined, according to the derived localization. In one embodiment, the scaling factor is applied to a single-channel downmix of the input signals to derive the output channel signals. In another embodiment, the scaling factor is applied to output channel signals derived by an initial format conversion so as to improve the spatial fidelity of the initial conversion.

These and other features and advantages of the present invention are described below with reference to the drawings.

DETAILED DESCRIPTION OF PREFERRED EMBODIMENTS

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting as to the scope of the invention but merely illustrative.

In accordance with several embodiments, provided is a frequency-domain method for format conversion of a multichannel audio signal intended for playback over a pre-defined loudspeaker layout, in order to achieve accurate spatial reproduction over a different layout potentially comprising a different number of loudspeakers. Embodiments of the present invention overcome spatial spreading or leakage limitations by using the frequency-domain spatial analysis/synthesis techniques described in pending U.S. patent application Ser. No. 11/750,300. This specification incorporates by reference in its entirety the disclosure of U.S. patent application Ser. No. 11/750,300, filed on May 17, 2007, and entitled Spatial Audio Coding Based on Universal Spatial Cues. In one embodiment of the present invention, the single-channel (or "mono") downmix step included in the spatial audio coding scheme is incorporated in the format conversion system. In another and preferred embodiment of the present invention, an alternative to the mono downmix step included in the spatial audio coding scheme described generally in U.S. patent application Ser. No. 11/750,300 is provided. This alternative, a general "passive upmix" technique, reduces or avoids signal leakage across channels.

Figure 1:
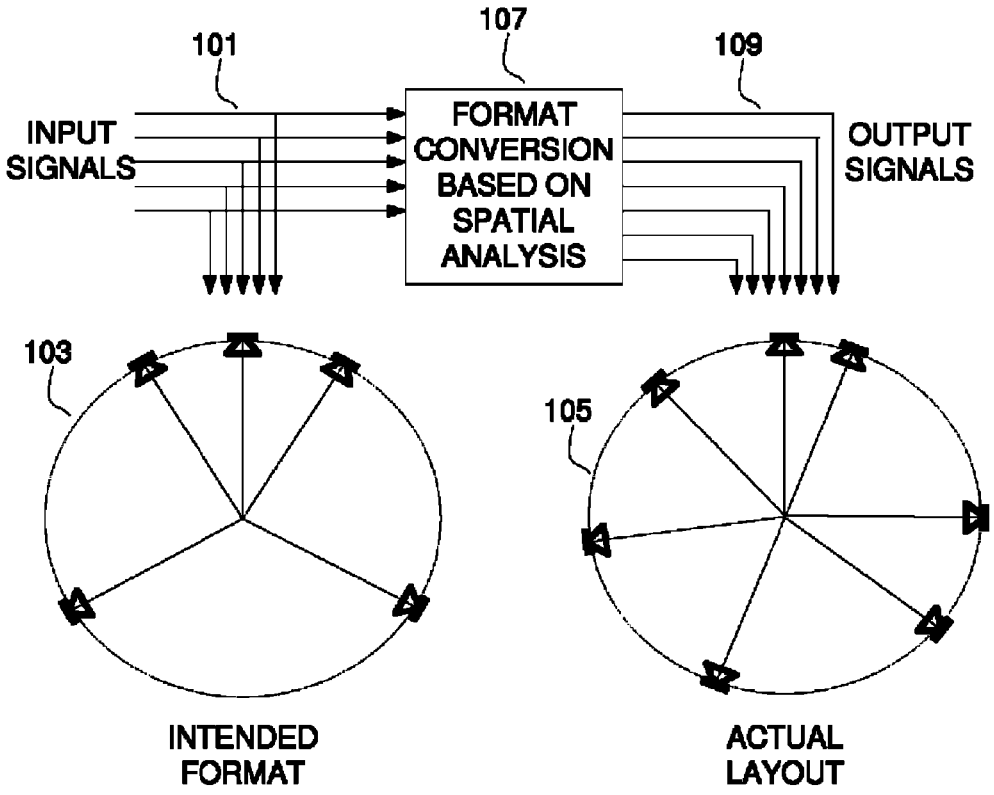
FIG. 1 is a diagram illustrating an overview of the process of format conversion in accordance with embodiments of the present invention.

FIG. 1 is a diagram illustrating an overview of the process of format conversion in accordance with one embodiment of the present invention. The input signals 101 comprise an ensemble of audio signals, for example a five-channel signal as shown or a two-channel stereo signal. The received input signals 101 are intended for reproduction over a pre-defined loudspeaker layout such as the standard five-channel layout 103. For instance, the input signals 101 are produced in a recording studio so as to provide a desired spatial impression over the standard layout 103. In practice, the actual layout of loudspeakers available for reproduction may differ from the layout format assumed during the audio production: the actual loudspeakers may not be positioned according to the production assumptions, and furthermore there may be a different number of input and output channels. The actual layout 105 depicts a seven-channel reproduction system with arbitrary loudspeaker positions not configured according to any established standard. Though seven speakers are shown, this is not intended to be limiting. That is, the diagram should be taken as a general representation of the output layout without limitation, including but not limited to limitations as to number or layout of speakers. For optimal reproduction quality, such that the spatial impression and fidelity of the input signals is preserved or even enhanced in the reproduction, a format conversion process 107 is required to generate appropriate output signals 109 for playback over the available reproduction layout. In accordance with embodiments of the present invention, this is a format conversion based on spatial analysis. The intended format 103 and the actual layout 105 should be taken as representative and not as a limitation of the present invention. The invention is not limited with respect to the number of input or output channels; more generally, the invention is not limited with respect to the format of the input (the assumed layout) or the format of the output (the actual layout), wherein the format comprises both the number of channels and the channel angles (i.e., the angles of the loudspeaker positions in the configuration measured with respect to the assumed frontal direction) in the layout. Rather, the invention is general with regards to the input and output formats, and the format converter 107 is needed for high-quality reproduction whenever the output format does not match the input format assumed by the content provider.

Figure 2:
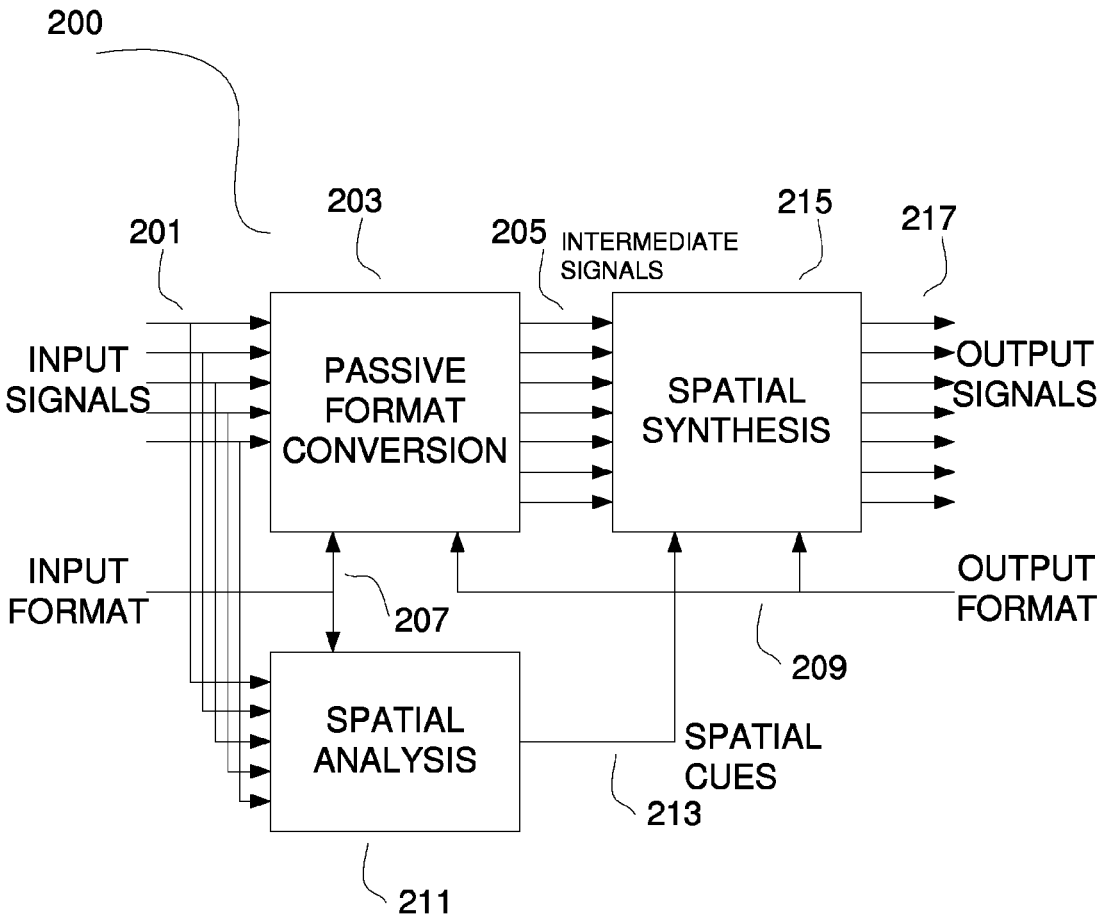
FIG. 2 depicts a format conversion system based on spatial analysis in accordance with embodiments of the present invention.

FIG. 2 is a block diagram depicting several embodiments of the present invention. The generalized format converter or "generalized upmix" system 200 operates as follows. The input signals 201 are first processed by a passive format converter or "passive upmix" in block 203 to generate intermediate signals 205, where the number of generated intermediate signals is equal to the number of output channels. The process in block 203 is referred to as "passive" since it depends only on the input format 207 and the output format 209 (which are provided to block 203 as shown), and does not depend on the actual signal content. Prior methods for format conversion have been based solely on such a passive format conversion process, and as such have been limited by spatial leakage (as described earlier) and by under-utilization of the available reproduction resources (for example, providing a zero-valued signal to an output loudspeaker).

The current invention overcomes the spatial limitations of prior methods by incorporating a spatial analysis process. FIG. 2 provides a block diagram in accordance with several embodiments of the invention. The input signals 201 and the input format 207 are provided to spatial analysis block 211, which derives spatial cues 213 that describe the spatial sound scene and are independent of the input channel format as disclosed in greater detail in U.S. patent application Ser. No. 11/750,300, filed on May 17, 2007, and entitled Spatial Audio Coding Based on Universal Spatial Cues. Details as to a preferred passive upmix algorithm are provided later in this specification. The spatial cues 213 and the output format 209 are provided to the spatial synthesis block 215, which processes the intermediate signals 205 to generate output signals 217. One advantage to this approach is that it is "speaker-filling"—it puts signal content in all of the output channels. This speaker-filling approach overcomes the resource under-utilization limitation of prior methods. The processing in spatial synthesis block 215 comprises deriving a set of weights based on the spatial cues 213 and output format 209. In one embodiment, the weights are applied respectively to the intermediate channel signals to derive the corresponding output signals. In another embodiment, the output signals are derived as a linear combination of the set of intermediate channel signals and the set of signals generated by applying the weights respectively to the intermediate channel signals. In a preferred embodiment, the linear combination applies a respectively larger weight to the set of signals generated by applying the weights to the intermediate channel signals, and a respectively smaller weight to the set of intermediate channel signals—such that the set of intermediate channel signals is added directly but at a low level into the set of output channel signals so as to hide artifacts and achieve a desired sound characteristic while still preserving the integrity of the spatial cues. It is preferred though not required that the weights are selected to preserve the spatial cues.

Figure 10:
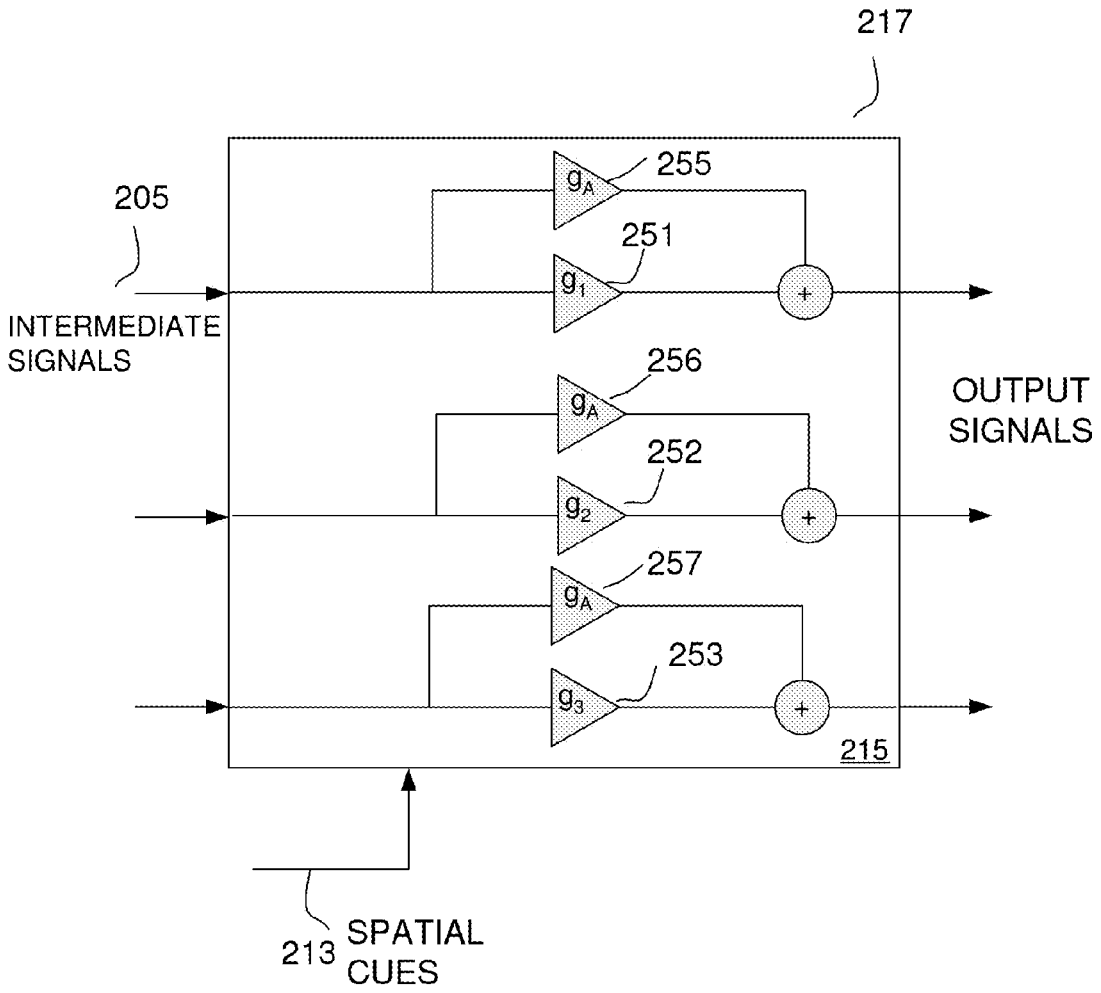
FIG. 10 is a diagram showing one embodiment of further detail regarding block 215 shown in FIG. 2.

FIG. 10 is a diagram showing one embodiment of further detail regarding block 215 shown in FIG. 2 for 3 intermediate channels and 3 output channels. The respective channel weights $g_1, g_2, g_3$ (see gain blocks 251, 252, and 253) can be applied to the intermediate channel signals 205 and combined in a linear combination with the intermediate signal modified by gain $g_\alpha$ (see gain blocks 255, 256, and 257) to implement the linear combination as noted above.

In FIG. 2, the input signals and output signals are indicated generically without reference to the actual signal representation; these could be time-domain signals or could correspond to time-frequency signal representations such as provided by the short-time Fourier transform (STFT) or the subband outputs of a filter bank. As such, the system 200 is a general processor which could be operating in any signal domain without limitation. In a preferred embodiment, the system 200 operates in the STFT domain; the input signals 201 correspond to an STFT representation of the original time-domain input signals, and the output signals 217 likewise correspond to an STFT-domain signal representation. The STFT-domain representation is advantageous in that it tends to resolve or separate out independent sources in the input audio (which typically consists of a mixture of multiple concurrent sources in the time domain) such that processing of the STFT representation at a certain time and frequency can be assumed to approximately correspond to processing a discrete audio source. This resolution enables approximately independent spatial analysis and synthesis of discrete sources in the input audio mixture, which reduces spatial artifacts in the format conversion.

Figure 3:
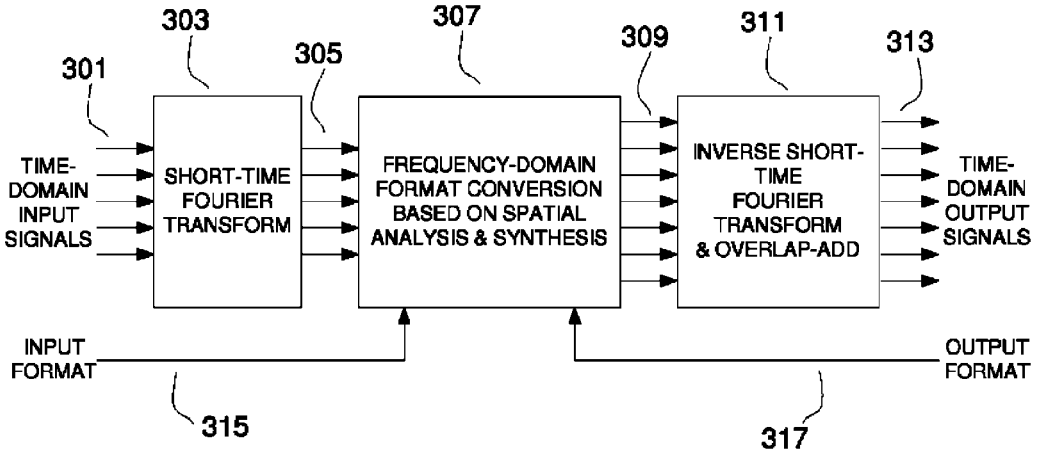
FIG. 3 depicts a format conversion system based on frequency-domain spatial analysis and synthesis in accordance with embodiments of the present invention.

FIG. 3 depicts a preferred embodiment wherein the format conversion is carried out in the STFT domain. Time-domain input signals 301 are converted to a frequency-domain representation by the short-time Fourier transform block 303. The STFT-domain input signals 305 are then provided to block 307, which implements format conversion based on spatial analysis and synthesis as depicted in block 200 of FIG. 2 and provides STFT-domain output signals 309 to block 311, which generates time-domain output signals 313 via an inverse short-time Fourier transform and overlap-add process. The input format 315 and the output format 317 are provided to the format conversion block 307 for use in the passive upmix, spatial analysis, and spatial synthesis processes internal to block 307 as depicted in system 200 of FIG. 2. While the format conversion 307 is shown as operating entirely in the frequency domain, those skilled in the art will recognize that in some embodiments certain components of block 307, notably the passive upmix, could be alternatively implemented in the time domain. This invention covers such variations without restriction.

The operation of the format conversion system 200 in FIG. 2 (or likewise block 307 in FIG. 3) is described in further detail in the following sections.

Input and Output Formats

Figure 4:
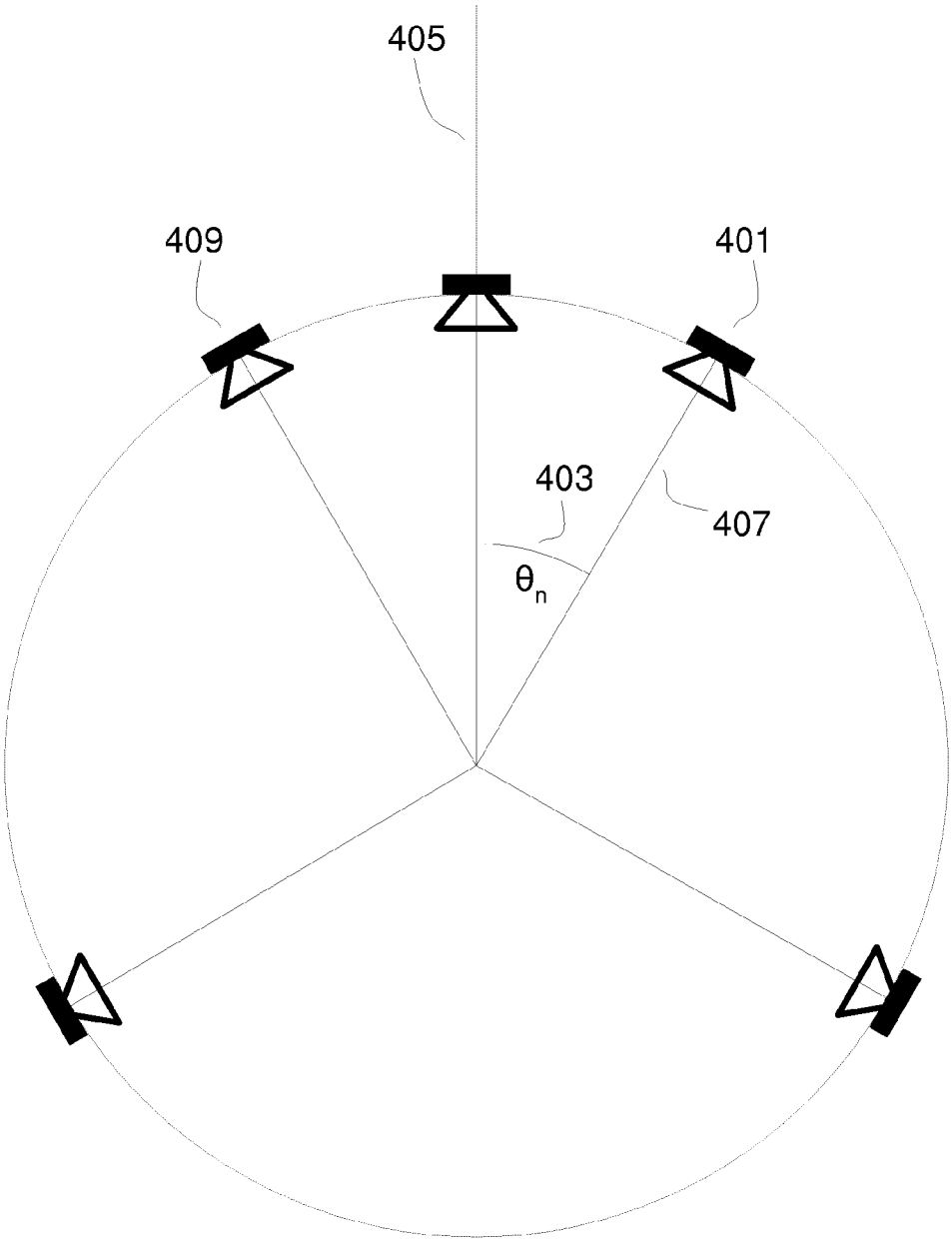
FIG. 4 depicts a channel format, format angles, and format vectors in accordance with embodiments of the present invention.

FIG. 4 shows a graphical illustration of a channel format or reproduction layout. For each channel, there is a corresponding "format vector" pointing in the direction of the associated channel angle. For instance, the channel indicated by loudspeaker 401 is positioned at azimuth angle 403 with respect to the frontal direction 405. As per industry standards, the frontal direction corresponds to azimuth angle 0°, which is, by convention, the channel azimuth angle for the front center channel in standard multichannel formats (such as 5.1). Denoting the angle of the n-th format channel by $\theta_n$, the corresponding format vector 407 can be written as $$\vec{p}_n = \begin{bmatrix} \sin(\theta_n) \\ \cos(\theta_n) \end{bmatrix}.$$

The angle $\theta_n$ is defined to be within the range [−180°, 180°] and is measured clockwise from the vertical axis such that channel position 401 corresponds to a positive angle and channel position 409 to a negative angle. An entire N-channel format or reproduction layout can thus be described equivalently as a set of angles $\{\theta_1, \theta_2, \theta_3, \ldots \theta_N\}$, a set of format vectors $\{\vec{p}_1, \vec{p}_2, \vec{p}_3, \ldots \vec{p}_N\}$ or as a "format matrix" whose columns are the format vectors:

$$P=[\vec{p}_1\ \vec{p}_2\ \vec{p}_3 \ldots \vec{p}_N].$$

Those skilled in the art will recognize that although for the purposes of illustration and specification the formats are depicted as two-dimensional (planar) and the format vectors are analogously comprised of two dimensions, the channel format vector description and the full current invention can be extended to three-dimensional layouts without limitation. In one non-limiting example, an embodiment of the invention applicable to a three-dimensional layout is achieved by adding an elevation angle for each channel and adding a third dimension to the format vectors.

Passive Upmix

This section describes the implementation of passive format conversion or "passive upmix" in accordance with several embodiments of the present invention. Several methods suitable for use in block 203 of FIG. 2 are presented. In general, an M-channel to N-channel passive format conversion process can be expressed as an N by M matrix C that generates a set of N output signals from M input signals:

$$\begin{bmatrix} y_1(t) \\ y_2(t) \\ \vdots \\ y_N(t) \end{bmatrix} = \begin{bmatrix} \ddots & & \\ & c_{nm} & \\ & & \ddots \end{bmatrix} \begin{bmatrix} x_1(t) \\ x_2(t) \\ \vdots \\ x_N(t) \end{bmatrix}.$$

At each time t, the input sample vector (of length M) is converted to an output sample vector (of length N) by matrix multiplication. This format conversion is referred to as "passive" in that the coefficients $c_{nm}$ of the conversion matrix C depend only on the input and output formats and not on the content of the input signals. Those of skill in the art will recognize that passive format conversion by matrix multiplication could be carried out on time-domain signals as shown in the above equation, on frequency-domain signals, or on other signal representations and still be in keeping with the scope of the present invention.

In one embodiment, the coefficients $c_{nm}$ of the conversion matrix are all selected to be equal. With this choice, the output signals of the passive format conversion are all identical. This choice corresponds to providing a single-channel downmix of the input signals to each of the output channels. In a preferred embodiment, the downmix signal is energy-normalized such that its energy is equal to the total energy in the input signals as taught in U.S. patent application Ser. No. 11/750,300. Energy normalization is preferred in that it compensates for potential cancellation of out-of-phase components in the downmix signal. In one embodiment of the invention, as taught in U.S. patent application Ser. No. 11/750,300, an energy-normalized downmix signal is computed as the sum of the input signals multiplied by a factor equal to the square root of the sum of the energies of the input signals divided by the square root of the energy of their sum.

In another embodiment, the coefficients $c_{nm}$ of the conversion matrix are selected according to the following procedure. Each input channel is considered in turn. For input channel m with channel angle $\phi_m$, the procedure first identifies the output channels i and j whose channel angles $\psi_i$ and $\psi_j$ are the closest output channel angles on either side of the input channel angle $\phi_m$. Then, pairwise-panning coefficients $c_{im}$ and $c_{jm}$ are determined for panning input channel m into output channels i and j. These coefficients are entered into the conversion matrix C in the (i,m) and (j,m) positions, respectively, and the other entries in the m-th column of C are set to zero. That is, each input channel is pairwise-panned into the nearest adjacent output channels. The pairwise panning coefficients $c_{im}$ and $c_{jm}$ are determined by an appropriate panning scheme such as vector-base amplitude panning (VBAP) or others known by those skilled in the art.

Figure 5:
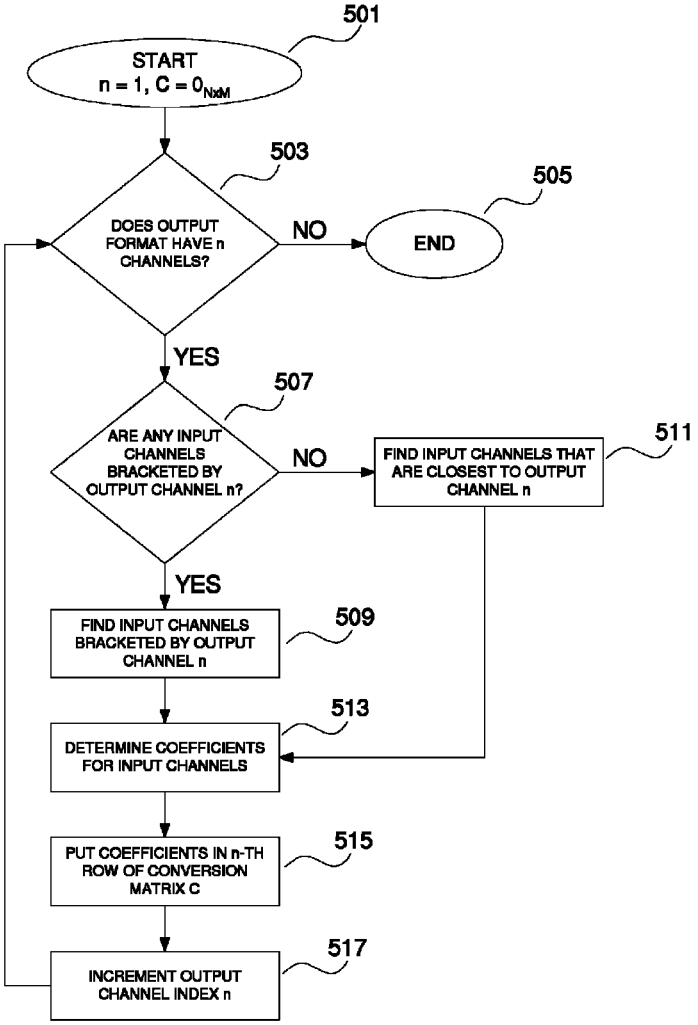
FIG. 5 is a flowchart describing a method for passive format conversion in accordance with embodiments of the present invention.

In a preferred embodiment, the passive format conversion matrix is configured according to the procedure depicted in FIG. 5. The process is initialized in step 501 with the output channel index n set to 1 and with the N-by-M conversion matrix C set to contain all zeros. In decision block 503, the channel index n is compared with the number of channels in the output format. If the output format does not comprise at least n channels, then the process is terminated in step 505. This decision block controls the iterations in the subsequent steps such that all output channels are treated by the procedure. If an n-th channel is present in the output format, the process continues with step 507. In step 507, it is determined whether output channel n brackets any of the input channels; that is, whether any input channel lies immediately (angularly) between output channel n and either of its (angularly) adjacent output channels. If so, the bracketed input channels are determined in step 509. If not, the nearest (angularly) pair of input channels to output channel n (on either side) are identified in step 511; in cases where a second nearest input channel is substantially far from the output channel n, e.g. farther away than a specified, in some embodiments only a single nearest input channel is identified; in cases where all input channels are substantially far from the output channel n, in some embodiments no input channels are identified. After a set of input channels are determined in either step 509 or step 511, a set of coefficients for these channels are determined in step 513. In one embodiment, these coefficients are determined by a vector panning procedure in which the format vector for output channel n is projected, e.g. using a least-squares projection, onto the subspace defined by the format vectors corresponding to the input channels identified in step 509 or 511. The set of coefficients is then determined in step 513 as the projection coefficients determined by this projection. Those of skill in the art will understand that other methods for determining the set of coefficients could be incorporated in the present invention. The invention is not limited in this regard, and alternate methods for determining these coefficients are within the scope of the invention. In step 515, the coefficients are inserted as the appropriate entries in the conversion matrix C (in the n-th row for coefficients associated with output channel n). In step 517, the output channel index is incremented. The process returns to decision block 503 to determine if the process should be terminated (in 505) or if the process should be continued. The decision process in 503 is equivalent to determining if the channel index n is less than or equal to the output channel count N; if not (meaning that n is greater than the output channel count N), then the process has considered all of the output channels. When step 505 is reached, the conversion matrix C is complete according to this embodiment. This embodiment of the passive upmix is preferred in that the signal derived for a given output channel is spatially consistent with signals in nearby input channels, and furthermore in that non-zero signals are provided to all of the output channels (if the nearby input channels are non-zero). Such speaker-filling passive upmix is advantageous for use in conjunction with the spatial synthesis in the present invention.

Those of skill in the art will understand that other methods of passive format conversion could be used in the present invention. The invention is not limited in this regard, and other methods of passive format conversion are within its scope. Those of skill in the art will also recognize that passive format conversion methods which provide output signals that are spatially consistent with the input signals are preferred in the current invention. Furthermore, those of skill in the art will further recognize that speaker-filling passive format conversion is preferable in the current invention to methods which leave some of the available output channels permanently silent.

Spatial Analysis

Figure 6:
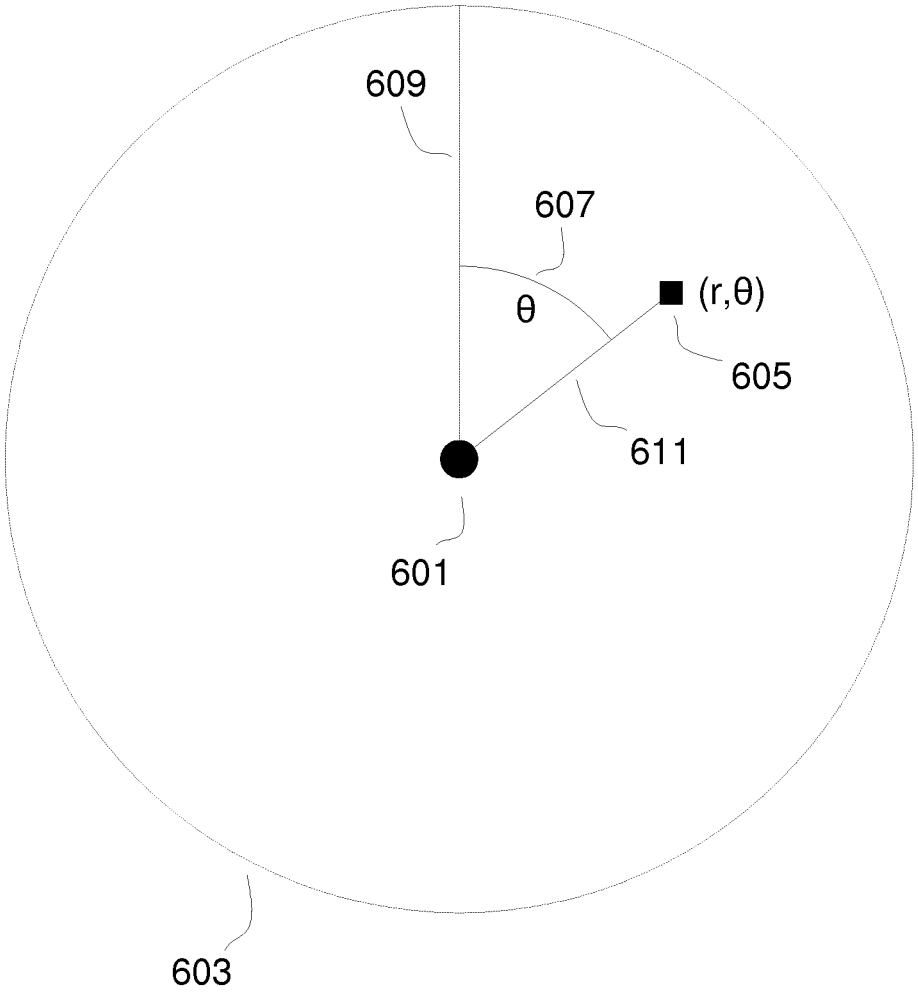
FIG. 6 is a depiction of the listening scenario on which the spatial analysis and synthesis are based in accordance with embodiments of the present invention.

In a preferred embodiment, the spatial analysis in block 211 of FIG. 2 is implemented in accordance with the teachings of U.S. patent application Ser. No. 11/750,300. FIG. 6 depicts the listening scenario assumed in the spatial analysis. The reference listening position 601 is at the center of a listening circle 603. The spatial analysis determines the localization of sound events within the listening circle; each sound event is characterized by polar coordinates (r,θ) describing the sound event's location 605. The radius r takes on a value between 0 and 1, where a 0 value corresponds to an omnidirectional or non-directional event and a value of 1 corresponds to a discrete point-source event on the listening circle. Values between 0 and 1 correspond to the continuum between non-directional and point-source events. The angle θ (indicated by 607) is measured clockwise from the vertical axis 609. The localization coordinates (r,θ) can equivalently be represented as a localization vector 611, denoted by $\vec{d}$ in the following. Those skilled in the art will recognize that the two-dimensional listening scenario depicted in FIG. 6 and described above can be extended to a three-dimensional listening scenario.

In a preferred embodiment, the sound events for which the spatial analysis determines localization vectors correspond to time-frequency components of the sound scene. In other words, at each time and frequency, the spatial analysis determines an aggregate localization of the time-frequency content of the channel signals. According to the teachings of U.S. patent application Ser. No. 11/750,300, the localization vector d is determined for each time and frequency as follows.

As a first step in the spatial analysis to determine the spatial localization vector $\vec{d}[k,l]$, the input channel format is described using unit-length format vectors ($\vec{p}_m$) corresponding to each channel position as described above. A normalized weight for each channel signal is then computed. In a preferred embodiment, the normalized coefficient for channel m is determined according to $$\alpha_m[k, l] = \frac{|X_m[k, l]|^2}{\sum_{i=1}^{M} |X_i[k, l]|^2}$$

where this normalization is preferred due to energy-preserving considerations. In an alternate embodiment, the normalized coefficient for channel m is determined according to $$\alpha_m[k, l] = \frac{|X_m[k, l]|}{\sum_{i=1}^{M} |X_i[k, l]|}.$$

Those skilled in the arts will recognize that other methods for computing such coefficients could be incorporated. The invention is not limited in this regard. In preferred embodiments, the coefficients $\alpha_m$ are normalized such that $$\sum_{m=1}^{M} \alpha_m = 1$$

and furthermore satisfy the condition $0 \le \alpha_m \le 1$. Using the format vectors and channel weights, an initial direction vector is computed according to $$\vec{g}[k, l] = \sum_{m=1}^{M} \alpha_m \vec{p}_m.$$

Note that all of the terms in the above equations are functions of frequency k and time l; in the remainder of the description, the notation will be simplified by dropping the [k,l] indices on some variables that are indeed time and frequency dependent. In the remainder of the description, the sum vector $\vec{g}[k,l]$ will be referred to as the Gerzon vector, as it is known as such to those of skill in the relevant arts.

The Gerzon vector $\vec{g}[k,l]$ formed by vector addition to yield an overall perceived spatial location for the combination of channel signals may in some cases need to be corrected. In particular, the Gerzon vector has a significant shortcoming in that its magnitude does not faithfully describe the radial location of sound events. As taught in U.S. patent application Ser. No. 11/750,300, the Gerzon vector is bounded by the inscribed polygon whose vertices correspond to the input format vector endpoints. Thus, the radial location of a sound event is generally underestimated by the Gerzon vector (except when the sound event is active in only one channel) such that rendering based on the Gerzon vector magnitude will introduce errors in the spatial reproduction.

In one embodiment of the present invention, the Gerzon vector $\vec{g}[k,l]$ is used as specified. In preferred embodiments, a modified localization vector is derived from the Gerzon vector so as to correct the radial localization error described above and thereby improve the spatial rendering. In one embodiment, an improved localization vector is derived by decomposing $\vec{g}[k,l]$ into a directional component and a non-directional component. The decomposition is based on matrix mathematics. First, note that the vector $\vec{g}[k,l]$ can be expressed as $$\vec{g}[k,l]=P\vec{\alpha}[k,l]$$

where P is the input format matrix whose m-th column is the format vector $\vec{p}_m$ and where the m-th element of the column vector $\vec{\alpha}[k,l]$ is the coefficient $\alpha_m[k,l]$. Since the format matrix P is rank-deficient (when the number of channels is sufficiently large as in typical multichannel scenarios), the direction vector $\vec{g}[k,l]$ can be decomposed as $$\vec{g}[k,l]=P\vec{\alpha}[k,l]=P\vec{\rho}[k,l]+P\vec{\epsilon}[k,l]$$

where $\vec{\alpha}[k,l]=\vec{\rho}[k,l]+\vec{\epsilon}[k,l]$ and where the vector $\vec{\epsilon}[k,l]$ is in the null space of P, i.e. $P\vec{\epsilon}[k,l]=0$ with $\|\vec{\epsilon}[k,l]\|_2>0$. Of the infinite number of possible decompositions of this form, there is a uniquely specifiable decomposition of particular value for the current application: if the coefficient vector $\vec{\rho}[k,l]$ is chosen to only have nonzero elements for the channels whose format vectors are adjacent (on either side) to the vector $\vec{g}[k,l]$, the resulting decomposition gives a pairwise-panned component with the same direction as $\vec{g}[k,l]$ and a non-directional component (whose Gerzon vector sum is zero). Denoting the channel vectors adjacent to $\vec{g}[k,l]$ as $\vec{p}_i$ and $\vec{p}_j$, we can write:

$$\begin{bmatrix}\rho_i\\ \rho_j\end{bmatrix}=\begin{bmatrix}\vec{p}_i & \vec{p}_j\end{bmatrix}^{-1}\vec{g}[k,l]$$

where $\rho_i$ and $\rho_j$ are the nonzero coefficients in $\vec{\rho}$, which correspond to the i-th and j-th channels. Here, we are finding the unique expansion of $\vec{g}$ in the basis defined by the adjacent channel vectors; the remainder $\vec{\epsilon}=\vec{\alpha}-\vec{\rho}$ is in the null space of P by construction. The i-th and j-th channels identified as adjacent to $\vec{g}[k,l]$ are dependent on the frequency k and time l although this dependency is not explicitly included in the notation.

Given the decomposition into pairwise and non-directional components specified above, the norm of the pairwise coefficient vector $\vec{\rho}[k,l]$ can be used to determine a robust localization vector according to:

$$\vec{d}[k,l]=\|\vec{\rho}[k,l]\|_1\left(\frac{\vec{g}[k,l]}{\|\vec{g}[k,l]\|_2}\right).$$

where the subscript "1" denotes the 1-norm of the vector, namely the sum of the magnitudes of the vector elements, and where the subscript "2" denotes the 2-norm of the vector, namely the square root of the sum of the squared magnitudes of the vector elements. In this formulation, the magnitude of $\vec{p}[k,l]$ indicates the radial sound position at frequency k and time l. Note that in the above we are assuming that the weights in $\vec{p}[k,l]$ are energy weights, such that $\|\vec{p}[k,l]\|_1=1$ for a discrete pairwise-panned source as in standard panning methods.

Figure 7:
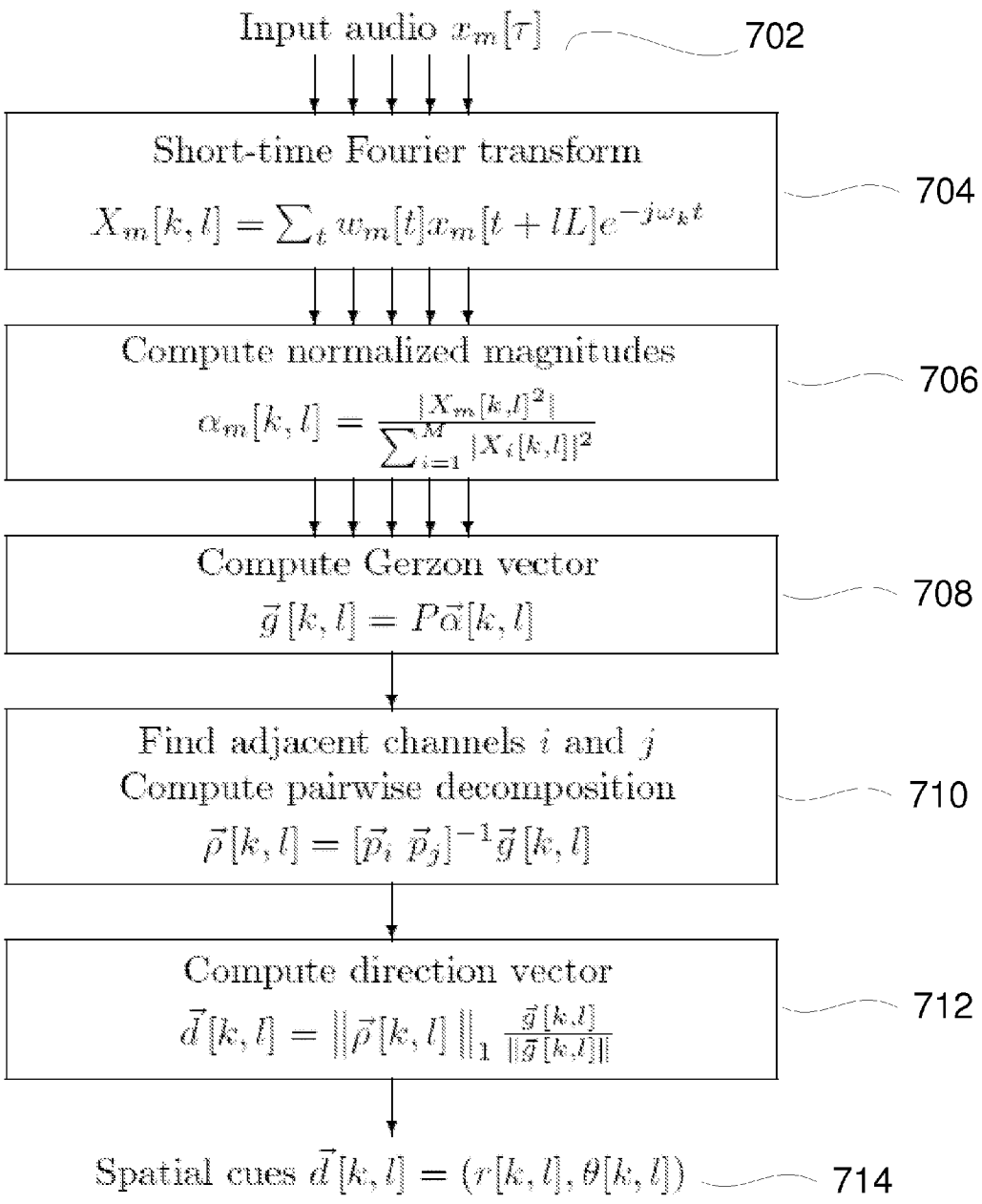
FIG. 7 is a flow chart illustrating a method for spatial analysis of multichannel audio in accordance with embodiments of the present invention.

The angle and magnitude of the localization vector $\vec{d}[k,l]$ are computed for each time and frequency in the signal representation. FIG. 7 is a flow chart of the spatial analysis method in accordance with one embodiment of the present invention. The method begins at operation 702 with the receipt of an input audio signal. In operation 704, a Short Term Fourier Transform is preferably applied to transform the signal data to the frequency domain. Next, in operation 706, normalized magnitudes are computed at each time and frequency for each of the input channel signals. A Gerzon vector is then computed in operation 708. In operation 710, adjacent channels i and j are determined and a pairwise decomposition is computed. In operation 712, the direction vector $\vec{d}[k,l]$ is computed. Finally, at operation 714, the spatial cues are provided as output values.

Those skilled in the arts will recognize that alternate methods for estimating the localization of sound events could be incorporated in the current invention. Thus, the particular use of the spatial analysis taught in U.S. patent application Ser. No. 11/750,300 is not a restriction as to the scope of the current invention.

Spatial Synthesis

In a preferred embodiment, the spatial synthesis in block 215 of FIG. 2 is implemented in accordance with the teachings of U.S. patent application Ser. No. 11/750,300. The spatial synthesis derives a set of weights (equivalently referred to as "scaling factors" or "scale factors") to apply to the outputs of the passive upmix so that the spatial cues derived from the input audio scene are preserved in the output audio scene. In other words, in embodiments of this invention, playback of the output signals over the actual output format is perceptually equivalent to playback of the input signals over the intended input format.

As a first step in the spatial synthesis, in a preferred embodiment the signals generated by the passive upmix are normalized to all have the same energy. Those of skill in the arts will understand that this normalization can be implemented as a separate process or that the normalization scaling can be incorporated into the weights derived subsequently by the spatial synthesis; either approach is within the scope of the invention.

The spatial synthesis derives a set of weights for the output channels based on the output format and the spatial cues provided by the spatial analysis. In a preferred embodiment, the weights are derived for each time and frequency in the following manner. First, the localization vector $\vec{d}[k,l]$ is identified as comprising an angular cue $\theta[k,l]$ and a radial cue $r[k,l]$. The output channels adjacent to $\theta[k,l]$ (on either side) are identified. The corresponding channel format vectors $\vec{q}_i$ and $\vec{q}_j$, namely the unit vectors in the directions of the i-th and j-th output channels, are then used in a vector-based panning method to derive pairwise panning coefficients $\sigma_i$ and $\sigma_j$ according to $$\begin{bmatrix} \sigma_i \\ \sigma_j \end{bmatrix} = [\vec{q}_i \;\; \vec{q}_j]^{-1}\vec{d}[k,l]$$

These coefficients are used to construct a panning vector $\vec{\sigma}$ which consists of all zero values except for $\sigma_i$ in the i-th position and $\sigma_j$ in the j-th position. The panning vector so constructed is then scaled such that $\|\vec{\sigma}\|_1=1$. The pairwise panning $\sigma_i$ and $\sigma_j$ coefficients capture the angle cue $\theta[k,l]$; they represent an on the-circle point in the listening scenario of FIG. 6, and using these coefficients directly to generate a pair of synthesis signals renders a point source at angle $\theta[k,l]$ and at radial position $r[k,l]=1$. Methods other than vector panning, e.g. sin/cos or linear panning, could be used in alternative embodiments for this pairwise panning process; the vector panning constitutes the preferred embodiment since it aligns with the pairwise projection carried out in the analysis.

To correctly render the radial position of the source as represented by the radial cue $r[k,l]$, a second panning is carried out between the pairwise weights $\vec{\sigma}$ and a non-directional set of panning weights, i.e. a set of weights which render a non-directional sound event over the given output configuration. An appropriate set of non-directional weights can be derived according the procedure taught in U.S. patent application Ser. No. 11/750,300, which uses a Lagrange multiplier optimization to determine such a set of weights for a given (arbitrary) output format. Those of skill in the arts will understand that alternate methods for deriving the set of non-directional weights may be employed in the present invention; the use of such alternate methods is within the scope of the invention. Denoting the non-directional set by $\vec{\delta}$, the overall weights resulting from a linear pan between the pairwise weights and the non-directional weights are given by $$\vec{\beta}[k,l]=r[k,l]\vec{\sigma}[k,l]+(1-r[k,l])\vec{\delta}.$$

where it should be noted that the non-directional set $\vec{\delta}$ is not dependent on time or frequency and need only be computed at initialization or when the output format changes. This panning approach preserves the sum of the panning weights as taught in U.S. patent application Ser. No. 11/750,300. Under the assumption that these are energy panning weights, this linear panning is energy-preserving. Those of skill in the art will understand that other panning methods could be used at this stage; other panning methods, such as quadratic panning, are within the scope of the invention.

The weights $\vec{\beta}[k,l]$ computed by the spatial synthesis procedure are then applied to the signals provided by the passive upmix to generate the final output signals to be used for rendering over the output format. The application of the weights to the channel signals is done in accordance with the channel index and the element index in the vector $\vec{\beta}[k,l]$. The i-th element of the vector $\vec{\beta}[k,l]$ determines the gain applied to the i-th output channel. In a preferred embodiment, the weights in the vector $\vec{\beta}[k,l]$ correspond to energy weights, and a square root is applied to the i-th element prior to deriving the scale factor for the i-th output channel. In one embodiment, the normalization of the intermediate channel signals is incorporated in the output scale factors as explained earlier.

In some embodiments, it may desirable for the sake of reducing artifacts or to achieve a desired spatial effect to apply the weights determined by $\vec{\beta}[k,l]$ only partially to determine the output channel signals from the intermediate channel signals. In such embodiments, a gain is introduced which controls the degree to which the weights $\vec{\beta}[k,l]$ are applied and the degree to which the intermediate channel signals are provided directly to the output. This gain provides a cross-fade between the signals provided by the passive format conversion and those provided by a full application of the spatial synthesis weights. Those of skill in the art will understand that this cross-fade corresponds to the derivation of a new scale factor to be applied to the intermediate channel signals, where the scale factor is a weighted combination of a set of unit weights (corresponding to providing the passive upmix as the final output) and the set of weights determined by $\vec{\beta}[k,l]$ (corresponding to applying the spatial synthesis fully).

In some embodiments, it may be desirable for the sake of reducing artifacts to smooth the set of scale factors derived by the spatial synthesis to generate a set of smoothed scale factors to use for generating the output signals, where such smoothing may be applied in any or all of the temporal dimension (in time), the spectral dimension (across frequency bands), and the spatial dimension (across channels) without limitation. Such smoothing procedures are within the scope of the present invention.

Figure 8:
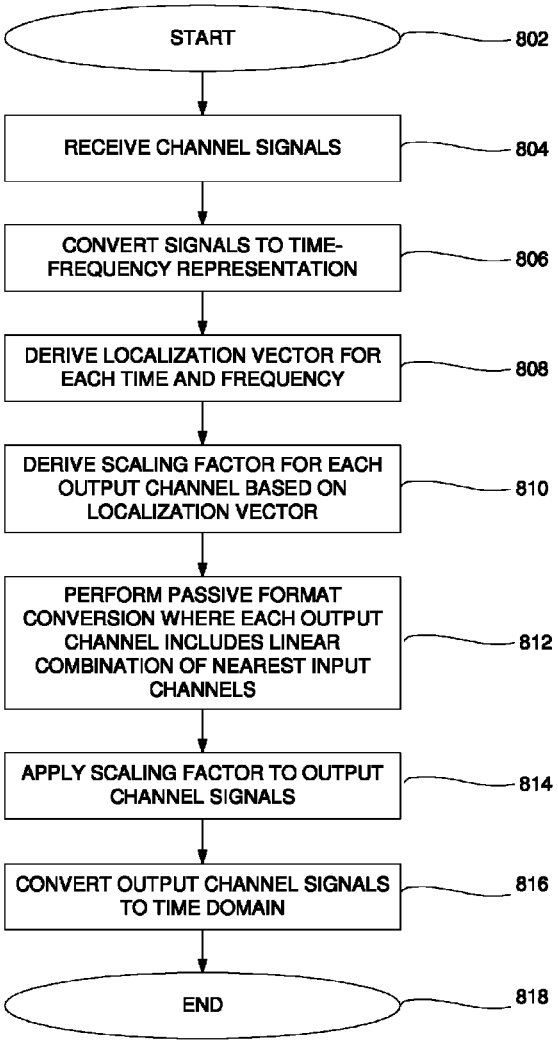
FIG. 8 is a flow chart illustrating a method of format conversion for an audio recording in accordance with one embodiment of the present invention.

FIG. 8 is a flowchart illustrating a format conversion method for an audio recording in accordance with one embodiment of the present invention. The method commences at 802. In operation 804, the channels of the audio recording are received. Next, at operation 806, the signals corresponding to the channels are converted to a time-frequency representation, in a preferred embodiment using the short-time Fourier transform. At operation 808, a spatial localization vector is derived for each time and frequency, in one embodiment as described in this specification in the section entitled "Spatial analysis" in this specification or as illustrated in FIG. 7. Next, at operation 810, a scaling factor for each channel is derived based on the spatial localization vector and the output format, in one embodiment as described earlier in this specification in the section entitled "Spatial synthesis". A scaling factor is associated to each output channel for each time and frequency. Next, in operation 812, a passive format conversion is performed. This conversion preferably includes in each output channel a linear combination of the nearest input channels. In step 814, the scaling factors derived in step 810 are applied to the output channels.

In step 816, the scaled output channel signals are converted to the time domain. The method ends at operation 818.

Primary-Ambient Decomposition

Figure 9:
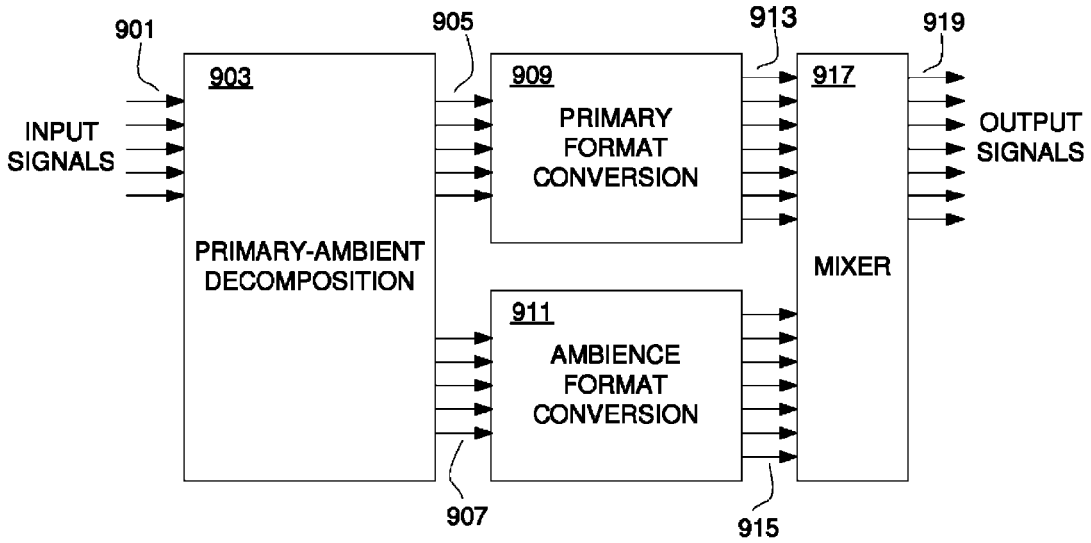
FIG. 9 is a block diagram illustrating a method of format conversion for an audio recording in accordance with one embodiment of the present invention.

It is often advantageous to separate primary and ambient components in the representation and synthesis of an audio scene. FIG. 9 provides a block diagram in accordance with embodiments of the current invention which incorporate primary-ambient decomposition. The input audio signals 901 are provided as inputs to a primary-ambience decomposition block 903 which in one embodiment operates in accordance with the teachings of U.S. patent application Ser. No. 11/750,300 regarding decomposition of multichannel audio into primary and ambient components. The primary-ambient decomposition method taught in U.S. patent application Ser. No. 11/750,300 carries out a principal component analysis on the frequency-domain input audio signals; primary components are determined for each channel by projecting the channel signals onto the principal component, and ambience components for each channel are determined as the projection residuals. Those of skill in the art will recognize that alternate methods for primary-ambient decomposition could be incorporated in block 903; the use of alternate methods is within the scope of the invention. Block 903 provides primary components 905 and ambience components 907 as outputs. These are supplied respectively to primary format conversion block 909 and ambience format conversion block 911, which operate in accordance with embodiments of the current invention. In alternate embodiments, the ambience format conversion also includes allpass filters and other processing components known to those of skill in the art to be useful for rendering of ambience components by introducing decorrelation of the ambience output channels 815. Blocks 909 and 911 provide format-converted primary channels 913 and format-converted ambience channels 915 to mixer block 917, which combines the primary and ambient channels, in one embodiment as a direct sum and in other embodiments using alternate weights, to determine output signals 919.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for multichannel surround format conversion of an audio recording from an input signal format to an output signal format, comprising:

converting an input signal to one of a frequency-domain or subband representation comprising a plurality of time-frequency tiles;

deriving a direction for each time-frequency tile in the plurality; and for each time-frequency tile, deriving a scaling factor for each output channel of the output signal format, according to the direction; wherein the input signal is a multichannel signal and is downmixed to a single-channel intermediate signal and wherein each output signal channel is obtained by receiving the intermediate signal and applying the scaling factor for the respective output channel for each time-frequency tile.

2. The method as recited in claim 1 further comprising deriving the input signal by extracting ambient sound components from the audio recording.

3. A method for multichannel surround format conversion of an audio recording from an input signal format to an output signal format, comprising:

converting an input signal to one of a frequency-domain or subband representation comprising a plurality of time-frequency tiles;

deriving a direction for each time-frequency tile in the plurality;

for each time-frequency tile, deriving a scaling factor for each output channel of the output signal format, according to the direction; and performing a passive format conversion wherein each output signal channel in the output signal is derived by linear combination of the input signal channels nearest to it in the layouts corresponding to the respective input and output signal formats and applying the scaling factor for the respective output signal channel for each time-frequency tile.

4. The method as recited in claim 3 wherein the each of the input signal format and the output signal format define layout information for at least one signal channel of the respective input signal and output signal.

5. The method as recited in claim 3 wherein the passive format conversion is performed on a Short Time Fourier Transform domain signal.

6. A method of upmixing or downmixing an input signal to an output signal format, the method comprising:

converting the input signal to an intermediate signal having the same number of channels as the output signal format;

spatially analyzing the input signal to identify spatial cues that are independent of the input signal format wherein the spatial analyzing localizes a sound event by determining a first associated parameter that describes the event's sound in the range from an omnidirectional source to a point-source and a second parameter that describes an angular position for the sound event; and processing those spatial cues to generate an output signal reflecting the spatial cues.

7. The method as recited in claim 6 wherein the processing comprises deriving a set of channel weights based on the spatial cues and the output signal format.

8. The method as recited in claim 7 wherein the derived channel weights are applied to the respective intermediate signal channels to derive the corresponding output signal.

9. The method as recited in claim 8 wherein the output signal is derived as a linear combination of the intermediate signal and the signal generated by applying the channel weights respectively to the intermediate signal channels.

10. The method as recited in claim 9 wherein linear combination applies a respectively larger contribution to the signal generated by applying the channel weights to the intermediate signal, and a respectively smaller contribution to the intermediate signal, the respective contribution amounts being selected such that the intermediate signal is added directly but at a low level into the output signal.

11. The method as recited in claim 6 wherein the conversion from the input signal format to the output signal format is performed in frequency domain.

12. The method as recited in claim 6 wherein the conversion from the input signal format to the output signal format is performed in time domain.

13. The method as recited in claim 6 wherein the input signal format is a 5.1 format and the output signal format is a 7.1 format.

14. An audio format conversion system configured for multichannel surround format conversion of an audio recording from an input signal format to an output signal format, the processor comprising:

an input port for receiving an input audio signal;

a frequency domain converter for converting an input signal to one of a frequency-domain or subband representation comprising a plurality of time-frequency tiles; and a processor configured for deriving a direction for each time-frequency tile in the plurality; for each time-frequency tile, deriving a scaling factor for each output channel of the output signal format, according to the direction; and performing a passive format conversion wherein each output signal channel in the output signal is derived by linear combination of the input signal channels nearest to it in the layouts corresponding to the respective input and output signal formats and applying the scaling factor for the respective output signal channel for each time-frequency tile.

* * * * *